US007467909B2

(12) United States Patent
Orner, Jr. et al.

(10) Patent No.: US 7,467,909 B2
(45) Date of Patent: Dec. 23, 2008

(54) ARRESTING SYSTEMS AND METHODS

(75) Inventors: Richard L. Orner, Jr., Oreland, PA (US); Joseph W. Lurquin, Jr., West Chester, PA (US); Thomas L. Quinn, Cochranville, PA (US); Donald Robertson, Devon, PA (US); Mark W. Allen, Malvern, PA (US)

(73) Assignee: Engineered Arresting Systems Corporation, Aston, PA (US)

( * ) Notice: Subject to any disclaimer, the term of this patent is extended or adjusted under 35 U.S.C. 154(b) by 0 days.

(21) Appl. No.: 11/393,269

(22) Filed: Mar. 30, 2006

(65) Prior Publication Data

US 2007/0258761 A1 Nov. 8, 2007

(51) Int. Cl.
*E01F 13/04* (2006.01)
*E01F 13/00* (2006.01)

(52) U.S. Cl. ..... 404/6

(58) Field of Classification Search ..... 404/6
See application file for complete search history.

(56) References Cited

U.S. PATENT DOCUMENTS

| | | | | | |
|---|---|---|---|---|---|
| 1,652,186 | A | | 12/1927 | Strauss | |
| 2,219,127 | A | * | 10/1940 | Buford | 49/9 |
| 2,237,106 | A | * | 4/1941 | Minert | 49/9 |
| 2,251,699 | A | * | 8/1941 | Banschbach | 49/9 |
| 2,336,483 | A | * | 12/1943 | Hoover | 49/9 |
| 2,440,574 | A | * | 4/1948 | Cotton | 244/110 R |
| 3,350,039 | A | * | 10/1967 | Crater | 244/110 A |
| 3,578,272 | A | * | 5/1971 | Thompson, Jr. | 244/110 C |
| 3,695,559 | A | * | 10/1972 | Cruger et al. | 244/110 C |
| 4,056,247 | A | | 11/1977 | Bernard et al. | |
| 4,780,020 | A | * | 10/1988 | Terio | 404/6 |
| 4,809,933 | A | * | 3/1989 | Buzby et al. | 244/110 C |
| 5,310,277 | A | | 5/1994 | Uotila | |
| 5,762,443 | A | * | 6/1998 | Gelfand et al. | 404/6 |
| 5,871,038 | A | | 2/1999 | Gompertz | |
| 6,131,873 | A | * | 10/2000 | Blazon et al. | 248/548 |
| 6,158,696 | A | * | 12/2000 | Brodskiy | 246/125 |
| 6,312,188 | B1 | * | 11/2001 | Ousterhout et al. | 404/6 |
| 6,779,756 | B1 | * | 8/2004 | Lopez | 244/110 A |
| 6,789,979 | B1 | * | 9/2004 | Jones | 404/6 |
| 6,843,613 | B2 | * | 1/2005 | Gelfand et al. | 404/6 |
| 7,083,357 | B2 | | 8/2006 | Lamore | |
| 7,140,802 | B2 | | 11/2006 | Lamore | |
| 2002/0085880 | A1 | * | 7/2002 | Schneider et al. | 404/6 |

FOREIGN PATENT DOCUMENTS

| | | |
|---|---|---|
| BE | 1008980 | 10/1996 |

OTHER PUBLICATIONS

International Search Report and Written Opinion mailed May 8, 2008 in International Application No. PCT/US2007/007466.

* cited by examiner

*Primary Examiner*—Raymond W Addie
(74) *Attorney, Agent, or Firm*—Dean W. Russell; Kilpatrick Stockton LLP

(57) ABSTRACT

Systems and methods for arresting vehicles or other moving objects are detailed. The systems may be bi-directional, so as to arrest vehicles on either side of a barrier. They additionally may be reset for reuse relatively rapidly following deployment.

4 Claims, 5 Drawing Sheets

ARRESTING SYSTEMS AND METHODS

FIELD OF THE INVENTION

This invention relates to systems and methods for impeding movement of moving objects and more particularly, although not necessarily exclusively, to bidirectional, reusable systems and methods for arresting travel of ground-based vehicles.

BACKGROUND OF THE INVENTION

U.S. Pat. No. 6,843,613 to Gelfand, et al. discloses an energy absorbing system forming part of an automobile barrier for placement preferably at a railroad crossing. The system includes a net stored in a pit spanning a roadway and parallel to railroad tracks. The net may be raised as an automobile approaches along the roadway in a particular travel direction; should the automobile not stop timely it will collide with the net, causing the automobile to cease travel prior to reaching the tracks.

The system of the Gelfand patent also contemplates placing a second automobile barrier opposite the railroad tracks from the first barrier. Such a two-barrier system is depicted especially in FIGS. 1A-1B of the Gelfand patent, with one net impeding automobile travel in a first direction along the roadway and the other net impeding travel in the direction opposite the first direction. In this sense each barrier of the Gelfand patent is only uni-directional, as the structure used to absorb energy functions only when the net is displaced toward the railroad tracks.

U.S. Pat. No. 6,779,756 to Lopez, owned commonly with this application, describes other systems for arresting aircraft or other vehicles. Designed typically for above-ground installation, these systems include dual arresting tapes provided on spools with brake assemblies positioned within hubs of the spools. The arresting tapes are designed for connection to a cable crossing a runway (or other travel area), with the cable being engaged typically by a tail hook associated with the vehicle to be arrested. For purposes of this application, the entire contents of both the Lopez and Gelfand patents are incorporated herein by this reference.

SUMMARY OF THE INVENTION

The present invention provides alternate systems and methods for arresting, or otherwise impeding, movement of objects such as vehicles. Systems of the invention may be bi-directional in operation and may be reset for reuse relatively rapidly after having been deployed. Such systems additionally may use some or substantially all of available stopping space when deployed, potentially reducing likelihood of injury to occupants of arrested vehicles.

Present systems preferably use a net as a barrier to travel. They additionally may include brake-in-spool assemblies and arresting tapes similar to those of the commonly-owned Lopez patent. In one version of the invention, retractable stanchions raise and lower the net from a laterally-slotted beam embedded in a roadway (or similar) surface. When undeployed, therefore, the net is typically positioned below grade. However, in another version of the invention the net rests above ground and is lowered from its resting position when deployed. In either version, sheave rollers may be included to permit bi-directional use of the systems.

Thus, at least some embodiments of the invention may comprise a pair of energy absorbers, in the form of brake assemblies, positioned at opposite sides of a roadway, runway, or other to-be-traveled surface. The assemblies may include tape reels, with associated tapes indirectly connected to each end of a net via a tape connector. Cooperating stanchions at each end of the net operate to raise or lower the net as needed, and sheave rollers through which the tapes pass rotate suitably to impede motion of the object engaging the net.

It thus is an optional, non-exclusive object of the present invention to provide systems and methods of absorbing energy so as to slow a moving object.

It is also an optional, non-exclusive object of the present invention to provide systems and methods of impeding movement of a vehicle or other object occupied by humans.

It is an additional optional, non-exclusive object of the present invention to provide systems of arresting vehicles, which systems may operate regardless of direction of travel of the vehicles along roadways.

It is another optional, non-exclusive object of the present invention to provide systems of arresting vehicles, which systems may be reset and reused.

It is a further optional, non-exclusive object of the present invention to provide systems and methods of arresting vehicles employing nets that may be either raised or lowered for deployment.

It is, moreover, an optional, non-exclusive object of the present invention to provide systems and methods of arresting vehicles utilizing friction brakes in connection with the nets.

Other objects, features, and advantages of the present invention will be apparent to those skilled in the relevant art with reference to the remaining text and drawings of this application.

DETAILED DESCRIPTION

Figure 1:
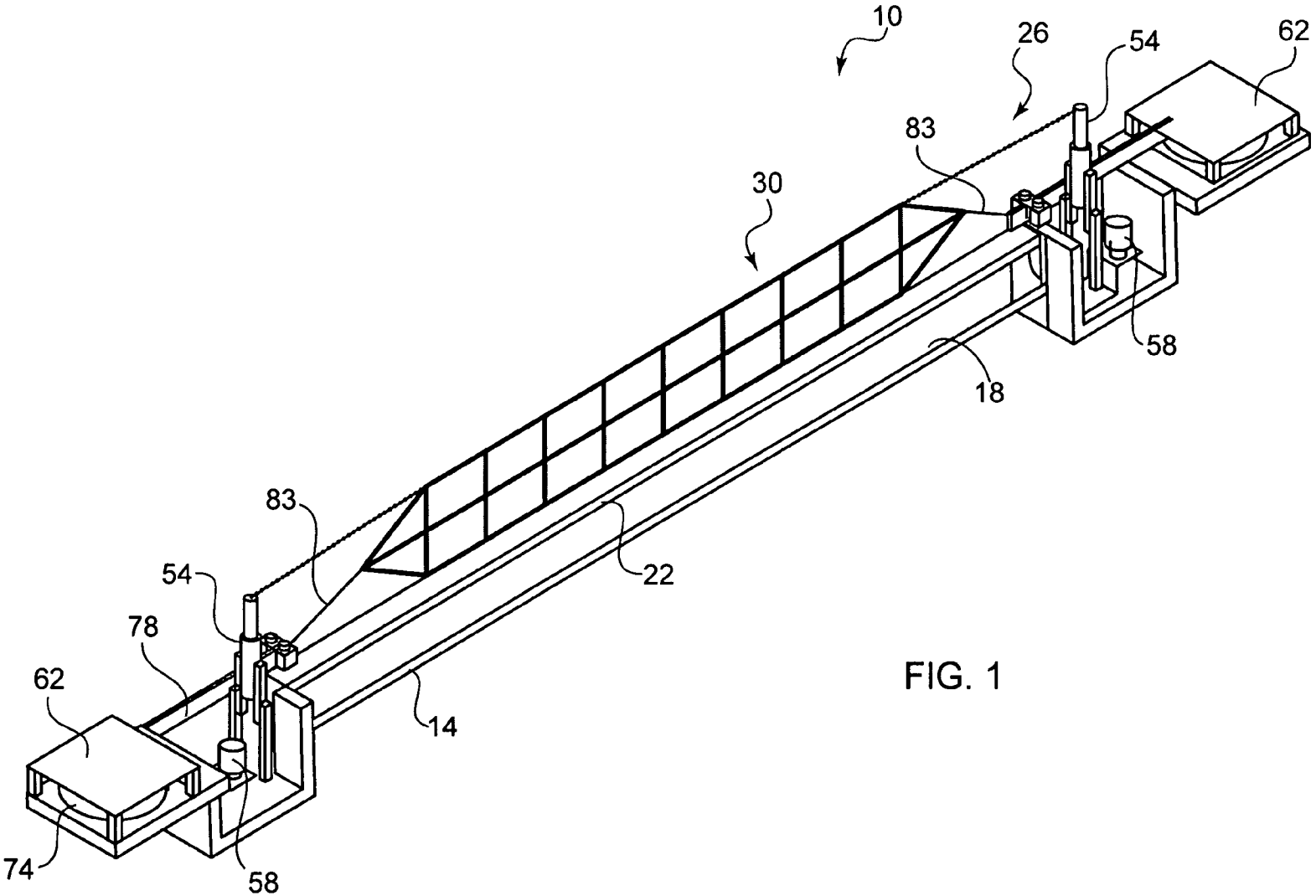
FIG. 1 is a cut-away, partial schematic view of an in-ground version of a system of the present invention.
Figure 2A:
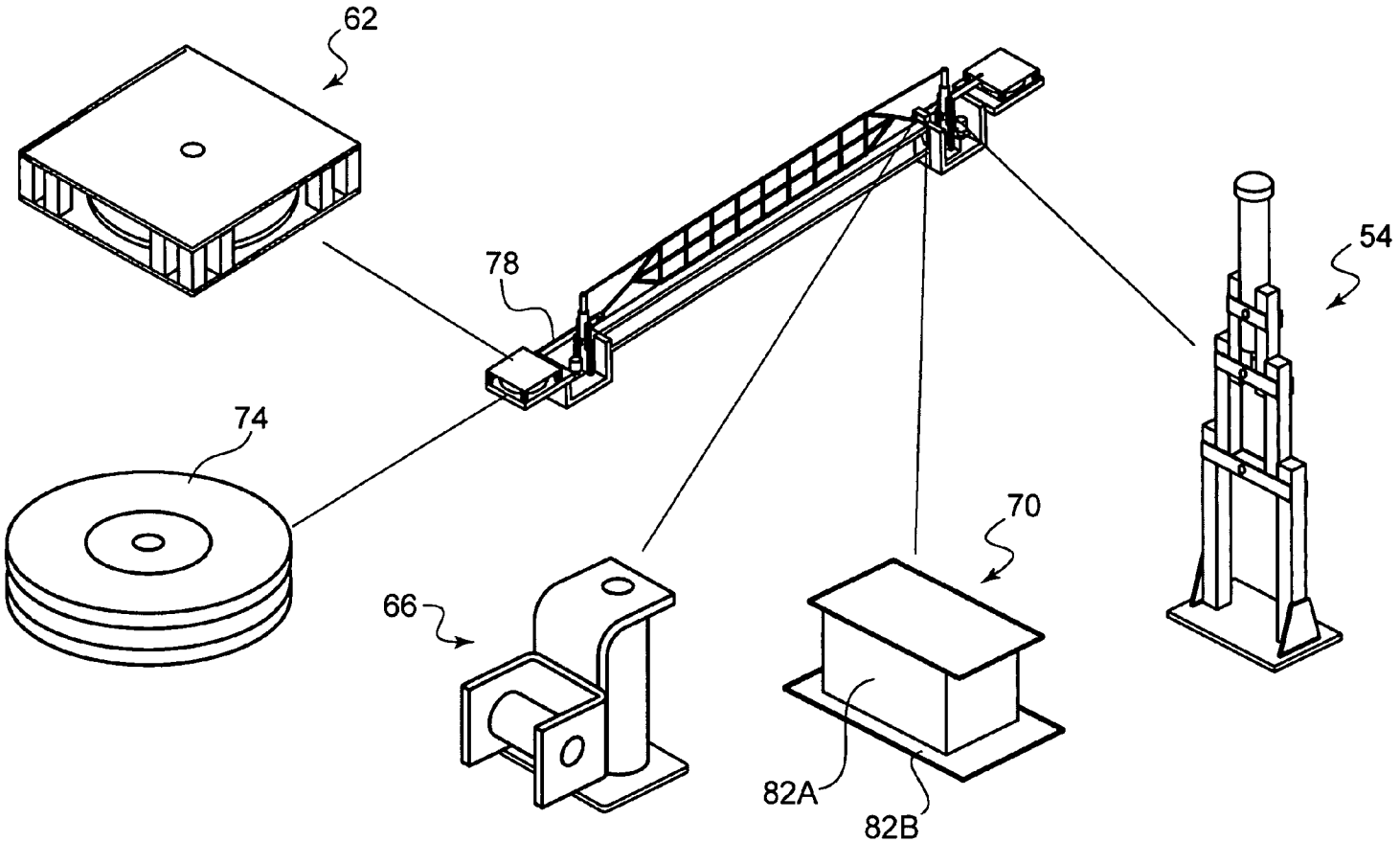
FIGS. 2A-B are another view of the system of FIG. 1 with selected components enlarged, with FIG. 2A depicting the system as deployed and FIG. 2B detailing the undeployed system.
Figure 2B:
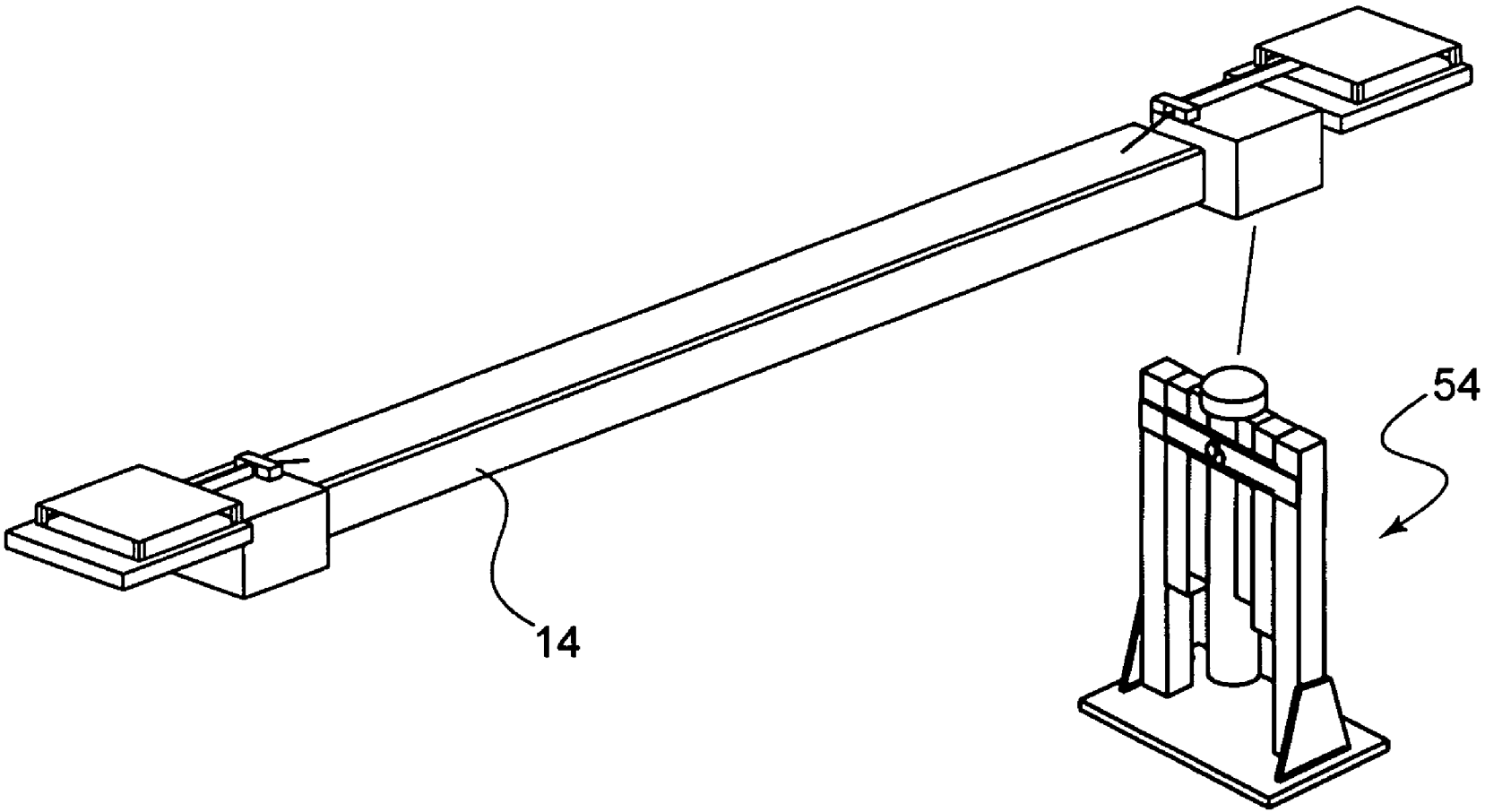

Depicted in FIGS. 1 and 2A-B is exemplary system 10 of the present invention. System 10 is denoted "in-ground" because many of its components are below grade (at least prior to deployment). Those skilled in the relevant field will recognize that not all components of system 10 need necessarily be below grade prior to deployment, so system 10 may be constructed differently than as shown in FIGS. 1 and 2A-C.

Nevertheless, system 10 preferably includes module 14, which beneficially may be a pre-cast block or beam of concrete. Module 14 typically will be elongated, with a length greater than the width of the roadway, runway, or other travel surface with which it is deployed. When positioned across such travel surface, therefore, module 14 will span its width.

Module 14 additionally is designed to be embedded in the travel surface with its upper surface 18 flush therewith. Upper surface 18 itself thus may form part of the travel surface.

Accordingly, module 10 should be of sufficient strength to bear loads consistent with vehicular traffic to which it will be exposed.

Preferably included within module 14 is a longitudinally-extending slot 22 that likewise spans the width of the travel surface with which it is deployed. Positioned within slot 22 may be an arrestor assembly 26 comprising, among other items, net 30. Net 30 may be made of natural or synthetic fabric (or both) or of any other material capable of withstanding contact with a moving vehicle while tensioned consistent with the invention.

Figure 4:
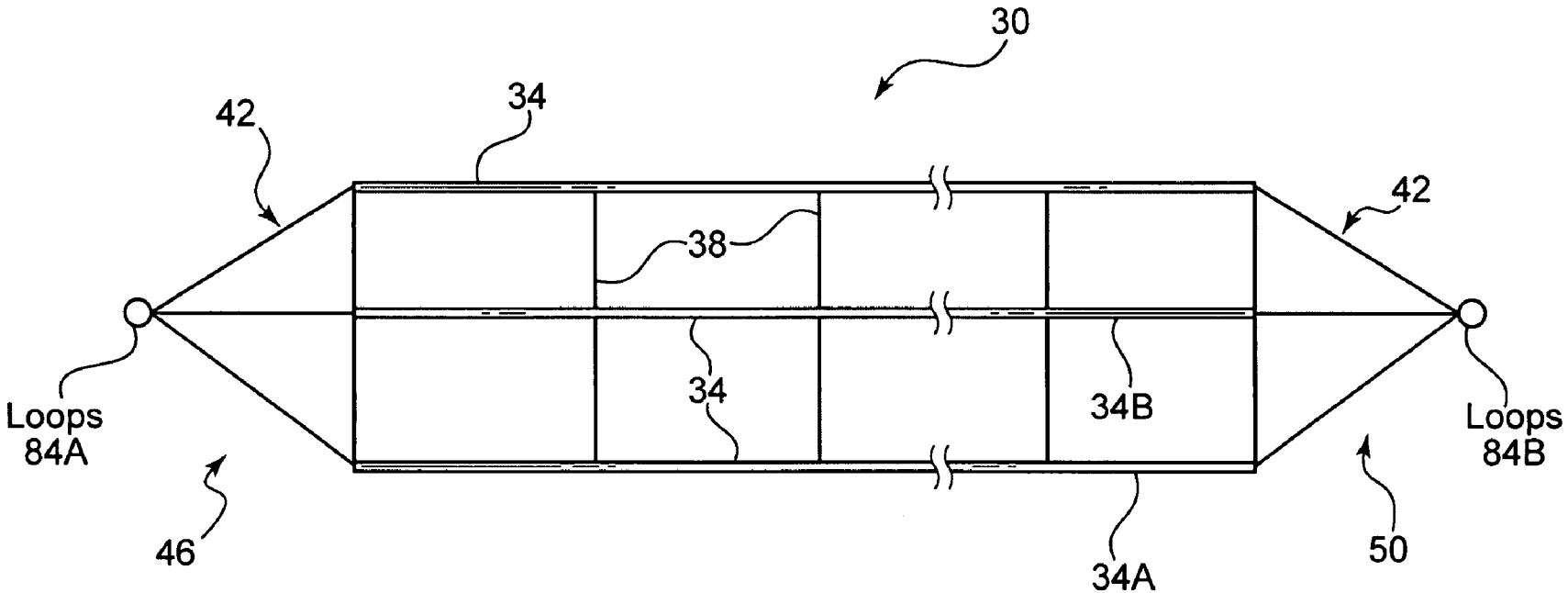
FIG. 4 is a plan view of a net useful as part of the systems of FIGS. 1-3B.

FIG. 4 depicts an exemplary configuration of net 30, with three spaced, generally-horizontal beams 34, a selected number of spaced, generally-vertical beams 38 as required for the width of the travel surface, and triangular sections 42 forming ends 46 and 50. Preferred versions of net 30 are made of synthetic fiber. However, those skilled in the art will understand that net 30 may be constructed other than as depicted and described herein.

Also included as part of arrestor assembly 26 may be stanchions 54. Each of a pair of stanchions 54 may be positioned adjacent an end 46 or 50 of net 30. Stanchions 54 function to raise net 30 out of slot 22 (i.e. above the travel surface) for deployment as shown in FIGS. 1 and 2A. They also serve to lower net 30 into slot 22 (i.e. below the travel surface) when not in use—as shown in FIG. 2B.

Preferred versions of stanchions 54 are electrically operated using motors 58. Stanchions 54 may be operated manually or otherwise as desired, however. In areas subject to low temperatures, heaters may be included as part of arrestor assembly 26 so as to facilitate operation of motors 58 and corresponding stanchions 54.

FIGS. 1 and 2A-B illustrate additional components of system 10. Such components may include brake assemblies 62, tape connectors 66, and sheave rollers 70, all of which preferably are (but need not necessarily be) located above grade. Advantageously one brake assembly 62, connector 66, and sheave roller 70 is associated with each end 46 and 50 of net 30 so that two of each component are included within system 10. Conceivably, however, more than two of each component may be employed if appropriate to do so.

Incorporated into each brake assembly 62 may be (at least one) reel 74 containing (at least one) tape 78. Reels 74 normally are oriented generally horizontally, so that they rotate about generally vertically-oriented axes. Assembly 62 may be constructed and operate generally as detailed in the Lopez patent: When a vehicle contacts and deforms deployed net 30, each tape 78 may unwind from its reel 74 while a brake within assembly 62 exerts force on the reel 74. Tapes 78 thus help absorb energy caused by the vehicle dynamically loading net 30. Although tapes 78 may unspool to any extent necessary to effect the purposes of system 10, applicants believe lower-weight passenger automobiles frequently may be stopped within approximately thirty-five feet of run-out of each tape 78 and heavy passenger vehicles stopped with as little as one hundred feet of run-out of tapes 78. Brake assemblies 62 alternatively may be rotary hydraulic brakes such as those provided by Engineered Arresting Systems Corporation of Aston, Pennsylvania under, e.g., the name "Water Twister."

Tapes 78 connect to respective ends 46 and 50 of net 30 via connectors 66 and sheave rollers 70. Threading tape 78 through sheave rollers 70 permits it to bear against (and therefore cause to rotate) either roller 82A or roller 82B, depending on the direction the to-be-arrested vehicle is moving relative to net 30. Connections preferably occur at loops 84A and 84A at respective ends 46 and 50, with cable, rope, or similar material 83 connecting the loops 84A and 84B to tape connectors 66. Such material 83 may be separate from beams 34 or a continuation of one or more of such beams 34.

Slot 22 preferably is approximately two inches wide, while tape 78 preferably is six inches wide and made of nylon or polyester. Again, however, neither width is critical. Instead, either or both of slot 22 and tape 78 may have different measurements if desired, and tape 78 may be made of other materials.

Optionally included as part of system 10 may be shear links designed to connect beams 34 to stanchions 54 and maintain the beams 34 under additional tension. These links may release under the stress of vehicle engagement, in which event their replacement would be required before system 10 is reused. Tapes 78 further are designed to be rewindable onto reels 74 post-use, so that system 10 may be reused without replacement of the tapes 78. Finally, a cover may be employed over slot 22 to reduce foreign objects from entering the slot 22, as long as the cover does not impede deployment of net 30.

Figure 3B:
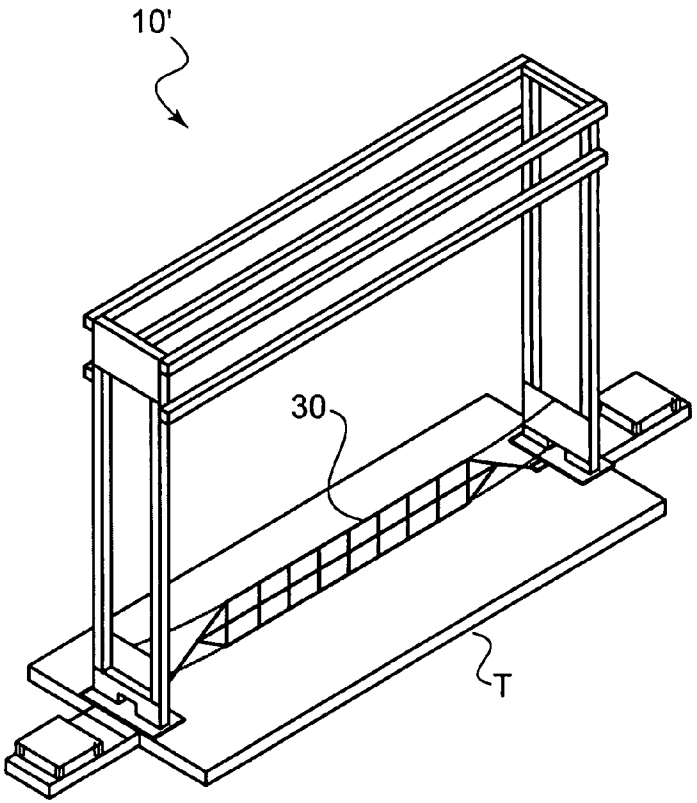
FIGS. 3A-B are views of an above-ground version of a system of the present invention, with FIG. 3A illustrating the system prior to deployment and FIG. 3B illustrating the deployed system.
Figure 3A:
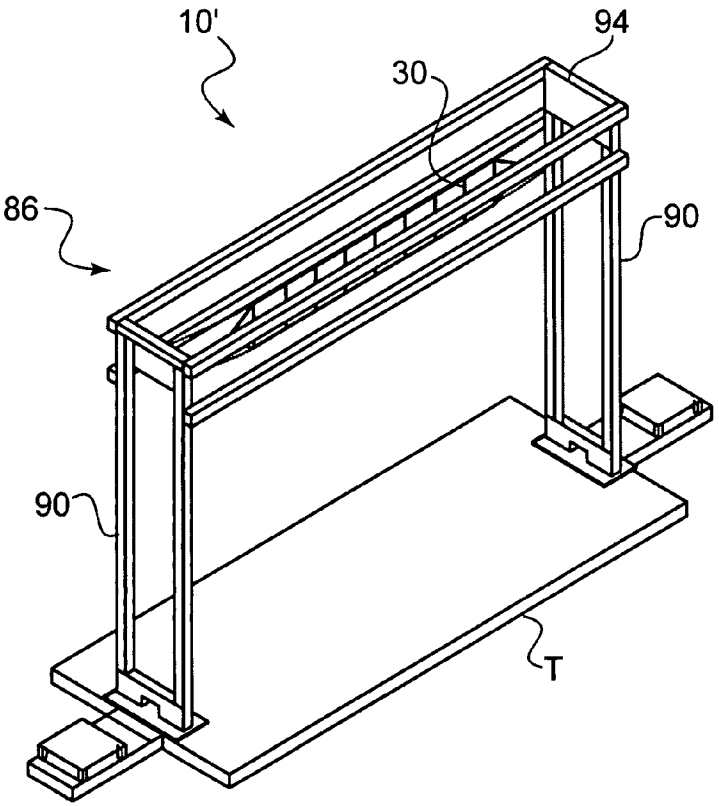

FIGS. 3A-B illustrate an alternative system 10' of the present invention. Components of system 10' are located above grade, so that the system 10' may be denoted an "above-ground" version of the invention. Rather than including slot 22 in which net 30 rests between deployments, system 10' includes superstructure or frame 86 extending above grade. Frame 86 includes opposed legs 90 to either side of travel surface T and between which net 30 extends. Net 30 normally is retracted at the top 94 of frame 86, well above the travel surface as shown in FIG. 3A. For deployment, net 30 may travel down legs 90 so as to be adjacent travel surface T (as illustrated in FIG. 3B). Preferably tapes 78 do not connect to net 30 until the net 30 is positioned as shown in FIG. 3B, likely requiring use of quick-connect/disconnect fasteners as part of system 10'.

Sensors associated with the travel surface may provide signals actuating either system 10 or system 10'. Should sensors for system 10 indicate that a travelling object should be arrested, system 10 would activate, with motors 58 causing stanchions 54 to expand. Such expansion of stanchions 54 in turn raises net 30 above the travel surface, thereby placing net 30 in the path of the to-be-arrested object. In certain embodiments of the invention the act of raising net 30 requires only two to three seconds, although faster or slower rise times may occur as appropriate. Further, net 30 need not be fully raised to function as an arrestor, as raising only a portion of net 30 above grade may be sufficient to arrest some vehicles and other objects.

Activation of system 10' is generally similar. If associated sensors indicate need to arrest an object traveling toward system 10', net 30 is lowered along legs 90 into position adjacent travel surface T and connected to tapes 78. These actions preferably require only three to five seconds, although again shorter or longer lowering times may occur.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A system for controlling arrestment of a vehicle containing at least one human occupant travelling in a path along a roadway in either a first direction or a second direction opposite the first direction, the system comprising:

a. a barrier having at least a portion positioned below the roadway so as not to intersect the path, the barrier being deformable in both of the first and second directions and comprising a fabric net comprising:

i. a plurality of generally horizontal members;

ii. a plurality of generally vertical members perpendicular to the horizontal members;

iii. at least one generally horizontal beam; and iv. a plurality of diagonal members forming an end;

b. means for repositioning the barrier so as to intersect the path, such means comprising a stanchion connected to the generally horizontal beam of the net and having at least a portion positioned below the roadway;

c. means for controlling deformation of the barrier following its contact with the vehicle, such means:

i. being configured to control deformation of the barrier in each of the first and second directions so that energy from the vehicle is absorbed and movement of the vehicle is arrested regardless of whether the vehicle is travelling in the first direction or the second direction; and ii. comprising:

A. at least one wound tape connected to the end of the net;

B. means, comprising a brake, for impeding unwinding of the tape following its contact with the object;

C. a reel acted upon by the brake; and

D. sheave rollers through which the tape passes; and d. a slotted beam having an upper surface substantially flush with the roadway and a portion extending therebeneath, the net being positioned in the slot prior to the barrier being repositioned; and in which (i) the tape plays out at least approximately thirty-five feet along the path after the vehicle contacts the net so as to absorb energy from and arrest movement of the vehicle in a manner non-lethal to the human occupant and (ii) the tape may be rewound onto the reel and the net may be returned to a position in the slot for reuse after arrestment of the vehicle.

2. A system for controlling arrestment of a vehicle containing at least one human occupant travelling in a path along a roadway in either a first direction or a second direction opposite the first direction, the system comprising:

a. a barrier having at least a portion positioned below the roadway so as not to intersect the path, the barrier being deformable in both of the first and second directions and comprising a net comprising:

i. a plurality of generally horizontal members;

ii. a plurality of generally vertical members perpendicular to the horizontal members;

iii. at least one generally horizontal beam; and iv. a plurality of diagonal members forming an end;

b. means for repositioning the barrier so as to intersect the path, such means comprising a stanchion connected directly or indirectly to the generally horizontal beam of the net and having at least a portion positioned below the roadway;

c. means for controlling deformation of the barrier following its contact with the vehicle, such means:

i. being configured to control deformation of the barrier in each of the first and second directions so that energy from the vehicle is absorbed and movement of the vehicle is arrested regardless of whether the vehicle is travelling in the first direction or the second direction; and ii. comprising at least one wound tape connected directly or indirectly to the end of the net; and d. a slotted beam having an upper surface substantially flush with the roadway and a portion extending therebeneath, the net being positioned in the slot prior to the barrier being repositioned; and in which (i) the tape plays out at least approximately thirty-five feet along the path after the vehicle contacts the net so as to absorb energy from and arrest movement of the vehicle in a manner non-lethal to the human occupant and (ii) the tape may be rewound and the net may be returned to a position in the slot for reuse after arrestment of the vehicle.

3. A system for controlling arrestment of a vehicle containing at least one human occupant travelling in a path along a roadway in either a first direction or a second direction opposite the first direction, the system comprising:

a. a barrier having at least a portion positioned below the roadway so as not to intersect the path, the barrier being deformable in both of the first and second directions and comprising a net;

b. means for repositioning the barrier so as to intersect the path, such means comprising a stanchion connected directly or indirectly to the net and having at least a portion positioned below the roadway;

c. means for controlling deformation of the barrier following its contact with the vehicle, such means:

i. being configured to control deformation of the barrier in each of the first and second directions so that energy from the vehicle is absorbed and movement of the vehicle is arrested regardless of whether the vehicle is travelling in the first direction or the second direction; and ii. comprising:

A. at least one wound tape connected directly or indirectly to the end of the net;

B. means, comprising a brake, for impeding unwinding of the tape following its contact with the object;

C. a reel acted upon by the brake; and

D. sheave rollers through which the tape passes; and d. a slotted beam having an upper surface substantially flush with the roadway and a portion extending therebeneath, the net being positioned in the slot prior to the barrier being repositioned; and in which (i) the tape plays out at least approximately thirty-five feet along the path after the vehicle contacts the net so as to absorb energy from and arrest movement of the vehicle in a manner non-lethal to the human occupant and (ii) the tape may be rewound onto the reel and the net may be returned to a position in the slot for reuse after arrestment of the vehicle.

4. A system for controlling arrestment of a vehicle containing at least one human occupant travelling in a path along a roadway in either a first direction or a second direction opposite the first direction, the system comprising:

a. a barrier having at least a portion positioned below the roadway so as not to intersect the path, the barrier being deformable in both of the first and second directions and comprising a net;

b. means for repositioning the barrier so as to intersect the path, such means connected directly or indirectly to the net and having at least a portion positioned below the roadway;

c. means for controlling deformation of the barrier following its contact with the vehicle, such means:

i. being configured to control deformation of the barrier in each of the first and second directions so that energy from the vehicle is absorbed and movement of the vehicle is arrested regardless of whether the vehicle is travelling in the first direction or the second direction; and ii. comprising at least one wound tape connected directly or indirectly to the end of the net; and d. a slotted beam having an upper surface substantially flush with the roadway and a portion extending therebeneath, the net being positioned in the slot prior to the barrier being repositioned; and in which (i) the tape plays out at least approximately thirty-five feet along the path after the vehicle contacts the net so as to absorb energy from and arrest movement of the vehicle in a manner non-lethal to the human occupant and (ii) the tape may be rewound and the net may be returned to a position in the slot for reuse after arrestment of the vehicle.

* * * * *